US008607489B1

(12) United States Patent
Calvert

(10) Patent No.: US 8,607,489 B1
(45) Date of Patent: Dec. 17, 2013

(54) STACKABLE AMMUNITION MAGAZINE

(71) Applicant: SMAG Associates, Trustee for SMAG CRT Trust, Manassas, VA (US)

(72) Inventor: S. Mill Calvert, Manassas, VA (US)

(73) Assignee: SMAG Associates, Manassas, VA (US), Trustee for SMAG CRT Trust ( * ) Notice: Subject to any disclaimer, the term of this patent is extended or adjusted under 35 U.S.C. 154(b) by 0 days.

(21) Appl. No.: 13/918,040

(22) Filed: Jun. 14, 2013

(51) Int. Cl.
*F41A 9/61* (2006.01)

(52) U.S. Cl.
USPC ..... 42/49.01; 42/6; 42/49.02; 42/50; 42/49.1

(58) Field of Classification Search
USPC ..... 42/49.01, 49.02, 50, 49.1
See application file for complete search history.

(56) References Cited

U.S. PATENT DOCUMENTS

| | | | | | |
|---|---|---|---|---|---|
| 2,391,756 | A | * | 12/1945 | Vesely | 42/18 |
| 3,110,122 | A | * | 11/1963 | Musgrave | 42/50 |
| 3,191,332 | A | * | 6/1965 | Ardolino | 42/50 |
| 3,736,686 | A | * | 6/1973 | Moller et al. | 42/6 |
| 4,430,821 | A | | 2/1984 | Vincent | |
| 4,765,223 | A | | 8/1988 | Beckmann | |
| 5,253,442 | A | * | 10/1993 | Kim | 42/50 |
| 5,642,581 | A | * | 7/1997 | Herold et al. | 42/1.02 |
| 5,666,752 | A | | 9/1997 | Grams | |
| 6,272,967 | B1 | | 8/2001 | Bender-Zanoni et al. | |
| 6,557,287 | B2 | | 5/2003 | Wollmann | |
| 8,365,454 | B2 | | 2/2013 | Hogan, Jr. | |
| 2002/0000059 | A1 | * | 1/2002 | Murello et al. | 42/75.03 |
| 2007/0107592 | A1 | | 5/2007 | Snow | |
| 2010/0126053 | A1 | * | 5/2010 | Fitzpatrick et al. | 42/50 |
| 2010/0281737 | A1 | * | 11/2010 | Cahill | 42/50 |

* cited by examiner

*Primary Examiner* — Samir Abdosh
(74) *Attorney, Agent, or Firm* — Louis Ventre, Jr.

(57) ABSTRACT

A magazine for a firearm holds cartridges in three sections: a top section, a middle section and a bottom section. The top section is detachable. The middle section has a smaller width and depth than the bottom section so that the middle section can be inserted into the bottom section of another similarly formed magazine. A removable bottom cover closes the bottom section. A spring with removable segments rests on the bottom cover. A c-shaped member fixed to each spring segment permits adding segments. Two magazines may be combined by removing the top section of a second magazine, detaching the bottom cover of a first magazine, removing a spring segment of the second magazine, connecting the shorter spring to the spring of the first magazine; and slidably inserting the middle section of the second magazine into the bottom section of the first ammunition magazine over the larger spring.

4 Claims, 2 Drawing Sheets

STACKABLE AMMUNITION MAGAZINE

TECHNICAL FIELD

In the field of breech-loading firearms, a magazine is structured to be slidably connectable to the bottom of another magazine to add additional capacity to hold ammunition for the firearm.

BACKGROUND ART

Magazines for hand guns and rifles typically have a fixed capacity for storage and delivery of ammunition to the gun. On occasion, such as a competition or an emergency situation, a policeman, soldier or sportsman can anticipate a need to be able to repeatedly fire more rounds than are held by a standard magazine. Typically, when a magazine runs out of ammunition, the shooter detaches that magazine from the well of the firearm and inserts another magazine loaded with ammunition.

Magazines typically hold the ammunition in a housing having a rectangular base with walls forming a column which may or may not narrow in width at the top. The magazine is sometimes referred to as a tube, although it is typically rectangular in cross section. The bottom of the magazine is open and usually terminates in an outwardly directed lip which is used to slidably attach a standard bottom cover to close it. The bottom cover is also known as a base pad.

The standard magazine typically includes a spring-loaded follower which feeds cartridges individually into the gun, usually from below. At the bottom of the magazine housing, a removable bottom cover provides a closure and a base support for the spring. The capacity of the standard magazine with a standard bottom cover is predetermined.

The typical magazine for a hand gun is detachable or removably housed in the handgun's grip. For a rifle, a magazine, sometimes referred to as a stick magazine, may be inserted into a rifle's magazine well. For purists, a gun magazine has a feeding spring and a clip does not. This standard accepted usage is observed herein.

Military rifles are capable of consuming large quantities of ammunition in a short time. For such applications, it would be useful to be able to carry smaller magazines that can be joined together rather than large and bulky high-capacity magazines. When preparing for engagement, it would be convenient to be able to modify the ammunition magazines to create one large magazine holding as much ammunition as may be used to meet expectations and battlefield conditions.

SUMMARY OF INVENTION

An ammunition magazine has a housing with three sections: a removable top section used to enable the exit of one cartridge at a time from the ammunition magazine; a middle section that is generally rectangular in cross-section and thus having a first width and a first depth; and a bottom section that is larger than the middle section in both width and depth, so that the bottom section can slidably receive the middle section of another similarly formed ammunition magazine. The ammunition magazine has a removable bottom cover used to open and close the bottom end of the bottom section. The ammunition magazine has a coiled compression spring that comes in removable sections that are affixed together using a c-shaped member so as to form a single spring that can be made longer or shorter by adding or removing spring sections. When assembled, the spring sections approximately align on the same axis within the housing. When inserted into the bottom section of a second ammunition magazine, the middle section is retained in place by a catch mechanism that includes a spring-operated button extending from the outer sidewall positioned at a point on the middle section of the first ammunition magazine and a mating hole in the bottom section of the second ammunition magazine. The ammunition magazine may include a removable carriage atop the spring that is disposed within the housing for urging the plurality of cartridges towards the housing exit.

In using a first ammunition magazine and a second ammunition magazine to make one larger capacity ammunition magazine, one removes the top section of the second ammunition magazine; removes the bottom cover of the first ammunition magazine; removes a spring segment of the second ammunition magazine to form a shorter spring; connects the shorter spring to the spring of the first ammunition magazine to form a larger spring; and slidably inserts the middle section of the second ammunition magazine into the bottom section of the first ammunition magazine over the larger spring.

TECHNICAL PROBLEM

Presently, there is no means to supplement the storage capacity of a magazine by sliding at least a portion of another magazine into its bottom end. Existing large capacity magazines can be bulky and inconvenient to carry or store on the belt of a shooter.

SOLUTION TO PROBLEM

It would be useful to have an ammunition magazine that can be reconfigured by inserting at least a portion of one magazine into the bottom end of another magazine to gain greater cartridge capacity. In this manner, more than one such magazine may be configured to be daisy-chained together to form a longer length and thus larger cartridge capacity magazine.

ADVANTAGEOUS EFFECTS OF INVENTION

Because a single stackable ammunition magazine can be small, a soldier or police officer does not have to carry around bulky, large capacity magazines on his belt, but he still has the ability to create a large capacity magazine when it is necessary to protect his life. A sportsman will have the ability to readily create an ammunition magazine of the desired storage capacity by stacking ammunition magazines together.

BRIEF DESCRIPTION OF DRAWINGS

The drawings illustrate preferred embodiments of the stackable ammunition magazine and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. For example, the steps in the method of the invention may be performed in any order that results using the stackable ammunition magazine.

Figure 1:
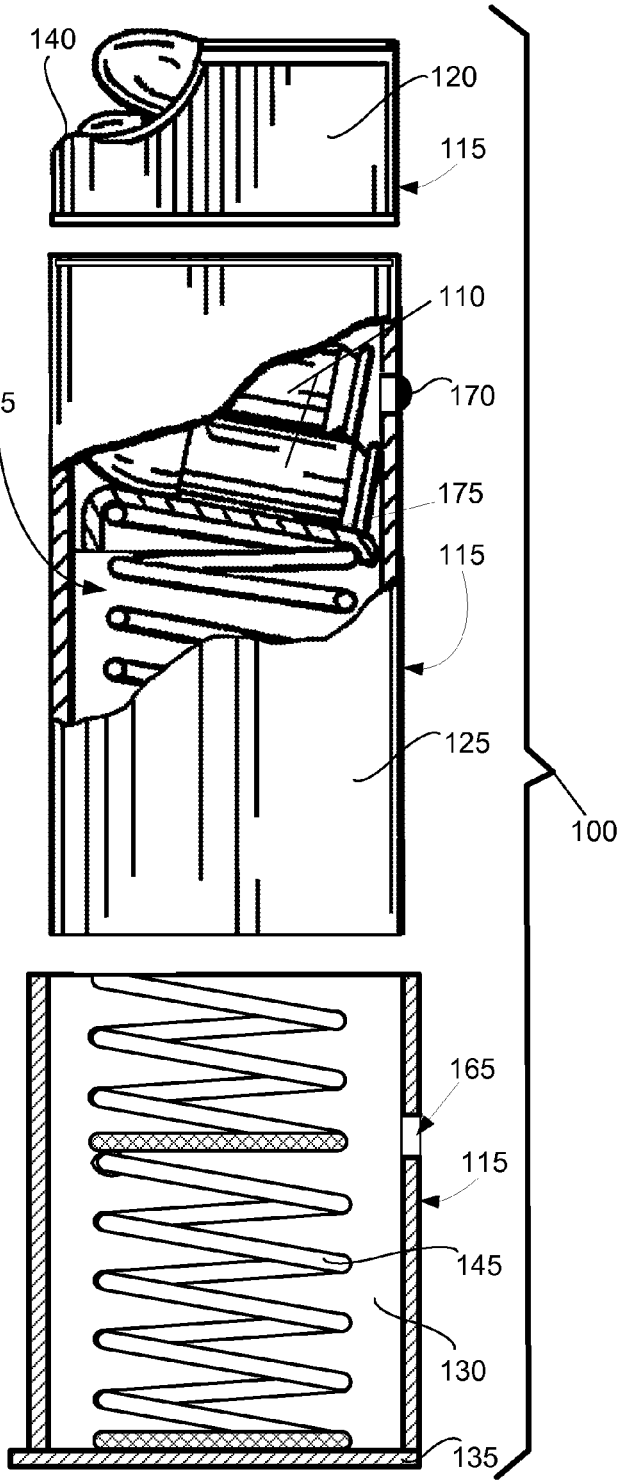
FIG. 1 is an exploded side elevation view of the three sections of a preferred embodiment of the stackable ammunition magazine.
Figure 3:
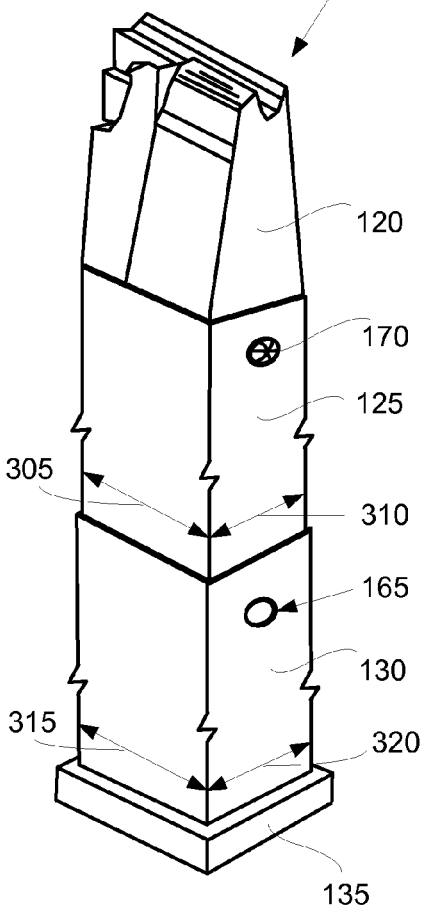
FIG. 3 is a perspective of a second embodiment of an ammunition magazine showing the top section, the middle section, the bottom section and the bottom cover.
Figure 5:
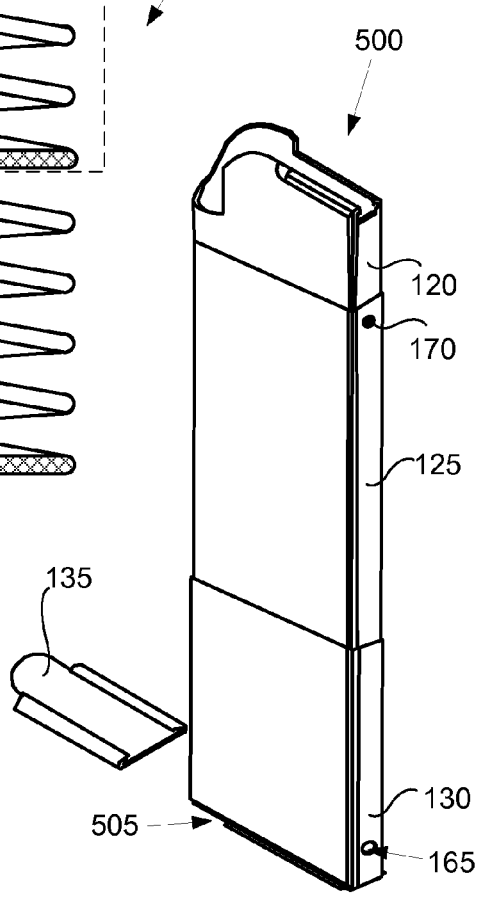
FIG. 5 is a perspective of a third embodiment of an ammunition magazine showing three sections of this ammunition magazine with the removable bottom cover removed from the bottom section.

Three preferred embodiments are illustrated to show a limited variety of ammunition magazines conforming to the invention. FIG. 1 shows an exploded view of preferred embodiment of a magazine (100) for storing and delivering ammunition to a firearm. The three separate sections shown in FIG. 1 are attached together to form the stackable ammunition magazine. FIG. 3 illustrates a second magazine embodiment (300) having a tapered top segment and wider lower portion, which is a common form in many semi-automatic handguns. The cartridges in this embodiment are staggered when in the lower portion, allowing a greater storage capacity. FIG. 5 is a third magazine embodiment (500) which is essentially a straight magazine where the rounds are stored aligned one on top of another.

The magazine (100) includes an elongated housing having an internal chamber (105) for holding a plurality of cartridges (110). The magazine (100) is also referred to herein as: an ammunition magazine or simply a magazine. The plurality of cartridges (110) is also referred to herein as: rounds; bullets; or ammunition. A firearm is also referred to herein as: a gun; a handgun; or a rifle.

The elongated housing has an outer sidewall (115), which in the exploded view in FIG. 1, is illustrated in three separated sections that are normally united together to form a single magazine. The three sections shown are: a top section (120), a middle section (125) and a bottom section (130).

The top section (120) is the part forming the exit fixture (140) that properly orients each bullet for loading in the firearm. The exit fixture (140) positions each cartridge within the elongated housing for proper chambering in the firearm.

The top section (120) is removable in order to enable proper flow of ammunition in an enlarged capacity magazine once the middle section (125) is inserted into the bottom section (130) of another magazine. The top section (120) preferably slides into the top of the middle section (125), locking in place. It may have a screw connection or other connecting means.

Figure 4:
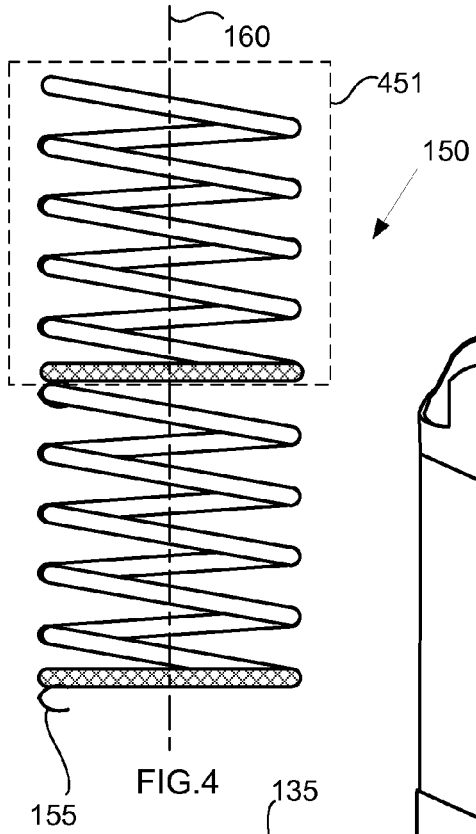
FIG. 4 is a side elevation view of a spring showing two removable spring segments.

The top section (120) may be any length, but has a preferable length that is one or more whole number multiples of the height of a spring segment (451). A general arrangement of the spring segment (451) is shown within the dashed box in FIG. 4. This preferable length enables removal of a fixed number of spring segments when preparing a magazine for insertion into the bottom section (130) of another magazine.

The middle section (125) is preferably configured to have a rectangular cross-section that is defined by a first width (305) and a first depth (310). A rectangular cross-section makes its mating with the bottom section (130) of another magazine a less-complicated procedure and is also consistent with a good fit into the receiving well of a gun into which the magazine is intended.

The bottom section (130) is defined by a second width (315) and a second depth (320) that are larger in dimension than the first width (305) and the first depth (310), respectively, such that the bottom section (130) will be able to receive the middle section (125) of another similarly formed magazine. Preferably, the bottom section (130) is just large enough so that there is a snug fit between the middle section (125) and the bottom section (130) once the middle section is inserted therein.

Figure 6:
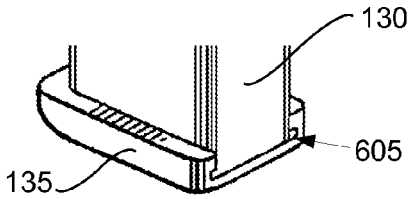
FIG. 6 is a perspective of the bottom end of the bottom segment showing a slidable removable bottom cover installed.

The magazine (100) includes a removable bottom cover (135), which closes the bottom section (130). The removable bottom cover (135) is sometimes referred to in the field as a base. FIG. 5 illustrates how the removable bottom cover (135) uses a first slidable engagement (505) to attach to the bottom section (130). FIG. 6 illustrates a second slidable engagement (605).

The magazine (100) includes a spring (145) comprising a plurality of removable spring segments (150). A spring segment (451) is identified in FIG. 4. The spring (145) is configured to rest on the removable bottom cover (135) from which it pushes up the cartridges toward the exit fixture (140). The spring (145) is preferably a rising helical structure. The spring (145) is also referred to as a coiled compression spring. The spring (145) is preferably in a shape roughly conforming to the shape of the internal chamber (105). Thus, for a generally rectangular magazine, the area within the rising helix of a gun magazine compression spring will also typically have a generally rectangular shape.

The magazine (100) includes a c-shaped member (155) fixed to each spring segment (451) in the plurality of removable spring segments (150), said c-shaped member (155) configured to slidably receive another spring segment (451) so as to link said removable spring segments (150) together to approximately align on the axis (160) within the housing. Thus, all the removable spring segments (150) in the spring (145) are on approximately the same axis.

Figure 2:
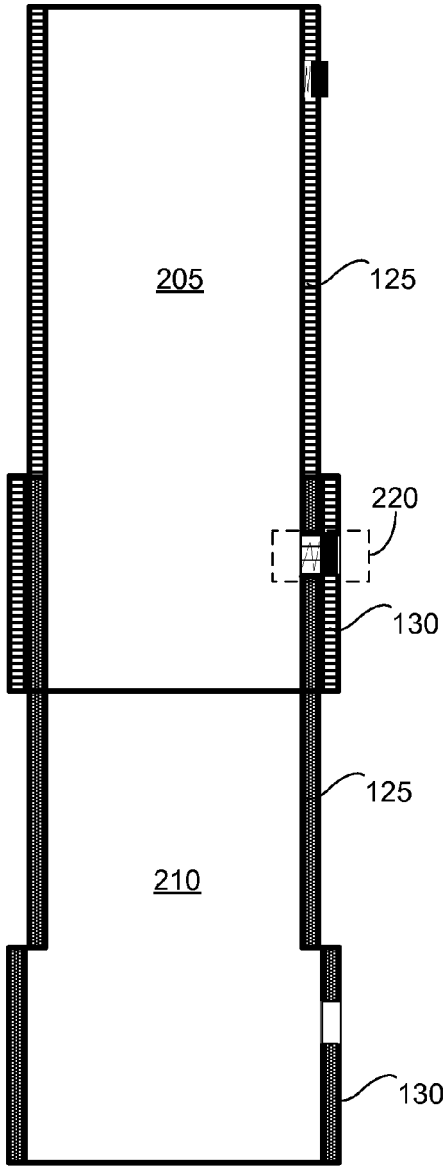
FIG. 2 is a sectional elevation view of the middle sections and bottom sections of two stackable ammunition magazines joined together.

The magazine (100) may further include a detent mechanism (220) shown within the dashed box in FIG. 2. The detent mechanism (220) is essentially a catch that locks the middle section (125) to the bottom section (130) when the two are combined to make a larger capacity magazine.

The detent mechanism (220) that is preferred includes a spring-operated button (170) extending from the outer sidewall (115) of the magazine, positioned or located at a point on the middle section (125). The spring-operated button (170) catches a hole or aperture (165) in the bottom section (130) of another magazine to lock the two components together. Thus, the bottom section (130) defines an aperture (165) for mating with the spring-operated button (170) on a second magazine.

The magazine (100) may include a removable carriage (175) that sits atop the spring (145). The removable carriage (175) is disposed within the internal chamber (105) for urging the plurality of cartridges (110) towards the exit fixture (140). The removable carriage (175) is detachable from the spring (145) so as to permit the addition or removal of a spring segment (451) or more than one spring segment (451).

FIG. 2 is a sectional elevation view of the middle sections and bottom sections of two stackable ammunition magazines joined together. While only two sections of each magazine (100) are shown, this figure may be consulted to visualize an assembled larger capacity magazine. A first magazine segment (205) comprising a middle section (125) and a bottom section (130) is shown with horizontal line hatching. A second magazine segment (210) comprising a middle section (125) and a bottom section (130) is shown with black and white dimpling.

The steps for using the aforementioned stackable ammunition magazine to add capacity to a magazine are relatively easily implemented. One must have at least two similarly configured stackable ammunition magazines available, but may repetitively perform the steps to make a magazine (100) of almost any capacity.

A method comprising these steps is described as a method for adding capacity 20 to a first ammunition magazine by using a portion of a second ammunition magazine.

The first ammunition magazine and the second ammunition magazine are similarly configured with each comprising a top section (120), a middle section (125), a bottom section (130), a removable bottom cover (135), and a spring (145), the spring (145) comprising a plurality of removable spring segments (150).

The method for adding capacity to a first ammunition magazine by using a portion of a second ammunition magazine comprises the steps of: removing the top section (120) of the second ammunition magazine; detaching the removable bottom cover of the first ammunition magazine; removing a removable spring segment of the spring (145) of the second ammunition magazine to form a shorter spring; connecting the shorter spring to the spring (145) of the first ammunition magazine to form a larger spring; and slidably inserting the middle section (125) of the second ammunition magazine into the bottom section (130) of the first ammunition magazine over the larger spring. The removable bottom cover (135) of the second ammunition magazine is already on the middle section (125) of the second ammunition magazine and it forms the bottom cover of the added capacity magazine created by implementing this method.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearm industry.

What is claimed is:

1. A magazine for storing and delivering ammunition to a firearm, the magazine comprising:

an elongated housing having an internal chamber for holding a plurality of cartridges, the elongated housing having an outer sidewall, a top section, a middle section and a bottom section;

the top section being removable and comprising an exit fixture to position each cartridge for proper chambering in the firearm;

the middle section having a generally rectangular cross-section and defined by a first width and a first depth;

the bottom section defined by a second width and a second depth that are larger in dimension than the first width and the first depth, respectively, such that the bottom section will be able to receive the middle section of another magazine formed with a middle section having a generally rectangular cross-section and defined by the first width and the first depth;

a removable bottom cover closes the bottom section;

a spring comprising a plurality of removable spring segments, the spring configured to rest on the removable bottom cover; and a c-shaped member fixed to each removable spring section in the plurality of removable spring segments, said c-shaped member configured to slidably receive another removable spring section so as to link said removable spring segments together to approximately align on the same axis within the elongated housing.

2. The magazine of claim 1, further comprising a detent mechanism, the detent mechanism comprising:

a spring-operated button extending from the outer sidewall positioned at a point on the middle section; and wherein the bottom section defines an aperture for mating with the spring-operated button on a second magazine.

3. The magazine of claim 1, further comprising a removable carriage atop the spring that is disposed within the internal chamber for urging the plurality of cartridges towards the exit fixture.

4. A method of adding capacity to a first ammunition magazine by using a portion of a second ammunition magazine, the first ammunition magazine and the second ammunition magazine being similarly configured with each comprising a top section, a middle section, a bottom section, a removable bottom cover, and a spring, the spring comprising a plurality of removable spring segments, the method comprising the steps of:

removing the top section of the second ammunition magazine;

detaching the removable bottom cover of the first ammunition magazine;

removing a removable spring segment of the spring of the second ammunition magazine to form a shorter spring;

connecting the shorter spring to the spring of the first ammunition magazine to form a larger spring; and slidably inserting the middle section of the second ammunition magazine into the bottom section of the first ammunition magazine over the larger spring.

* * * * *